US007601043B2

(12) United States Patent
Lee et al.

(10) Patent No.: US 7,601,043 B2
(45) Date of Patent: Oct. 13, 2009

(54) METHOD OF MANUFACTURING MICROHOLES IN A CATHODE SUBSTRATE OF A FIELD EMISSION DISPLAY USING ANODIC OXIDATION

(75) Inventors: Kun Hong Lee, Pohang (KR); Sun Kyu Hwang, Pohang (KR); Ok Joo Lee, Pohang (KR)

(73) Assignee: Postech Foundation, Pohang (KR)

( * ) Notice: Subject to any disclaimer, the term of this patent is extended or adjusted under 35 U.S.C. 154(b) by 542 days.

(21) Appl. No.: 10/542,378

(22) PCT Filed: Dec. 26, 2003

(86) PCT No.: PCT/KR03/02851

§ 371 (c)(1),
(2), (4) Date: Jul. 14, 2005

(87) PCT Pub. No.: WO2004/064101

PCT Pub. Date: Jul. 29, 2004

(65) Prior Publication Data

US 2006/0049742 A1 Mar. 9, 2006

(30) Foreign Application Priority Data

Jan. 15, 2003 (KR) ..... 10-2003-0002716

(51) Int. Cl.
*H01J 9/00* (2006.01)

(52) U.S. Cl. ..... 445/24; 445/50; 445/51

(58) Field of Classification Search ..... 313/495–497, 313/309–311; 445/24, 25, 49–51
See application file for complete search history.

(56) References Cited

U.S. PATENT DOCUMENTS

| | | | | |
|---|---|---|---|---|
| 4,940,916 | A * | 7/1990 | Borel et al. | 313/306 |
| 5,100,355 | A * | 3/1992 | Marcus et al. | 445/24 |
| 5,148,078 | A | 9/1992 | Kane | |
| 6,626,724 | B2 * | 9/2003 | Yamamoto et al. | 445/24 |
| 2001/0006325 | A1 * | 7/2001 | Choi et al. | 313/495 |
| 2004/0027052 | A1 * | 2/2004 | Choi et al. | 313/495 |

FOREIGN PATENT DOCUMENTS

| | | | |
|---|---|---|---|
| CN | 1286500 | A | 3/2001 |
| EP | 1073090 | A2 | 1/2001 |
| JP | 10-199398 | A | 7/1998 |

(Continued)

OTHER PUBLICATIONS

Chinese Office Action with English translation for related Chinese Application No. 200380108868.3, 10 pages (Jun. 6, 2008).

(Continued)

*Primary Examiner*—Mariceli Santiago
(74) *Attorney, Agent, or Firm*—Rothwell, Figg, Ernst & Manbeck, PC

(57) ABSTRACT

A field emission display (FED) with an integrated triode structure is provided. The FED can be manufactured without using a complex packaging process and have a significantly reduced well diameter and a significantly reduced cathode-to-anode distance. In the FED, front and rear panels form a single body using an anode insulating layer as an intermediate. A method for manufacturing the FED using anodic oxidation is also provided.

9 Claims, 8 Drawing Sheets

FOREIGN PATENT DOCUMENTS

| | | | |
|---|---|---|---|
| JP | 10-199400 | A | 7/1998 |
| KR | 1020020041664 | A | 6/2002 |
| KR | 1020020041665 | A | 6/2002 |
| WO | WO 96/08028 | | 3/1996 |
| WO | WO 2004012218 | A1 * | 2/2004 |

OTHER PUBLICATIONS

European Supplemental European Search Report for related Application No. 03779024.3-2208, 3 pages (Jun. 10, 2008).

* cited by examiner

METHOD OF MANUFACTURING MICROHOLES IN A CATHODE SUBSTRATE OF A FIELD EMISSION DISPLAY USING ANODIC OXIDATION

CROSS REFERENCE TO RELATED APPLICATIONS

This application is a 35 U.S.C. § 371 National Phase Entry Application from PCT/KR03/002851, filed Dec. 26, 2003, and designating the U.S.

BACKGROUND OF THE INVENTION

1. Field of the Invention

The present invention relates to a field emission display (FED).

2. Description of the Related Art

Field emission displays (FEDs) are those that emit light by collision of phosphors with cold electrons which are emitted into a vacuum from the surfaces of metals and semiconductors by tunneling effect caused under strong electric field.

FEDS emit light when phosphors are stimulated by an electron beam, like cathode ray tubes (CRTs). Therefore, FEDs have many advantages such as full color, full gray scale, high brightness, fast response time, wide viewing angle, wide operation temperature and humidity range. Furthermore, FEDs can be realized in the form of flat panel displays (FPDs) that are thin and lightweight, and emit little electromagnetic rays.

FEDs can be used not only as image display devices, but also as vacuum fluorescent displays, fluorescent lamps, white light sources, and back lights of liquid crystal displays (LCDs).

An example of a typical structure of FEDs is illustrated in FIG. 1.

A cathode 2 made of electroconductive metal and a resistive layer 3 made of amorphous silicon (a-Si) are sequentially formed on a substrate 1. A gate insulating layer 4 made of an insulating material is formed on the resistive layer 3 and has a well 4*a* in which a portion of the surface of the resistive layer 3 is exposed. An emitter 5 is positioned on the exposed surface of the resistive layer 3 in the well 4*a*. The gate insulating layer 4 has thereon a gate electrode 6 with a gate 6*a* corresponding to the well 4*a*. The substrate 1, the cathode 2, the resistive layer 3, the gate insulating layer 4 having the well 4*a*, the emitter 5, and the gate electrode 6 constitute a rear panel.

An anode 7 as a transparent electrode is positioned above the gate electrode 6 while being spaced apart from the gate electrode 6 by a predetermined distance. The anode 7 is formed on the inner surface of a front plate 8 that forms, together with the substrate 1, a hermetically sealed vacuum gap. A phosphor layer (not shown) is formed on or adjacent to the inner surface of the anode 7. The anode 7, the phosphor layer, and the front plate 8 constitute a front panel.

The rear and front panels are spaced a predetermined distance apart from each other by a spacer (not shown) and edges of them are hermetically sealed. A vacuum gap is defined between the rear and front panels.

The operation principle of FEDs is as follows. A voltage is applied between the gate electrode 6 and the cathode 2 using various matrix addressing techniques. When a voltage is applied between the gate electrode 6 and the cathode 2, tunneling effect takes place, and thus, electrons are emitted from the emitter 5. The electrons are accelerated by anode voltage and then hit the phosphor layer positioned on the inner surface of the anode 7. The stimulated phosphor layer emits light.

In order to facilitate electron emission from the emitter by tunneling effect, a distance between the tip of the emitter and the gate 6*a* must be short. In this regard, it is advantageous to set the diameter of the well to be shorter. Recently, efforts have been made to form the well having its diameter of about 0.5 to 2 μm, preferably 1 μm or less. By way of an example, Korean Patent Application Laid-Open Publication No. 2002-0041665 discloses a method of forming a well with a sub-micro diameter using an anodic oxidation process.

In FEDs, as a gap between the rear and front panels increases, a distance between the cathode and the anode increases. In this regard, in order to directly head electrons emitted from the emitter toward the anode, a significantly high voltage must be applied between the cathode and the anode. However, such a high voltage requires an increase of capacities of devices used in a drive circuit for FEDs, whereby increase of a production cost of FEDs is incurred. In addition, when an operation voltage of FEDs increases, an electric power consumption of FEDs increases as well.

In conventional FEDs, rear and front panels are manufactured in separate fabrication processes and then assembled while maintaining a predetermined gap therebetween by a spacer. However, those skilled in the art would understand that a packaging process of assembling front and rear panels after installing a spacer between the front and rear panels is an undue burden process.

SUMMARY OF THE INVENTION

The present invention provides a field emission display (FED) with an integrated triode structure. The field emission display can be manufactured without using a complex packaging process and have a significantly reduced well diameter and a significantly reduced cathode-to-anode distance.

The present invention also provides a method for manufacturing the FED.

According to an aspect of the present invention, there is provided a FED with an integrated triode structure, comprising: a substrate; a cathode layer positioned on the substrate; a gate insulating layer, which is positioned on the cathode layer and has a plurality of sub-microholes arranged in a regular pattern; a gate electrode layer, which is positioned on the gate insulating layer and has a plurality of sub-microholes arranged in the substantially same pattern as that of the sub-microholes in the gate insulating layer; an anode insulating layer, which is positioned on the gate electrode layer and has a plurality of sub-microholes arranged in the substantially same pattern as that of the sub-microholes in the gate insulating layer; emitters, which are positioned in wells defined by the sub-microholes in the gate insulating layer, the gate electrode layer and the anode insulating layer, and the emitters being adhered to the cathode layer; a phosphor layer positioned on the anode insulating layer; and an anode layer positioned on the phosphor layer.

The FED with an integrated triode structure may further comprise a resistive layer to be positioned between the cathode layer and the gate insulating layer. In this case, the emitters are adhered to the resistance layer.

According to another aspect of the present invention, there is provided a method for manufacturing a FED with an integrated triode structure, the method comprising: (a) forming, on a substrate, a cathode layer, a gate insulating layer, a gate electrode layer, and an aluminum layer, in order; (b) converting the aluminum layer to an alumina layer using anodic oxidation, until the alumina layer has sub-microholes in a regular arrangement pattern and a barrier layer remained at the lower part of the sub-microholes; (c) extending the depth of the sub-microholes in the alumina layer to the surface of the cathode layer; (d) forming emitters in the sub-microholes, the emitters being adhered to the cathode layer; (e) forming a phosphor layer on the alumina layer; and (f) forming an anode layer on the phosphor layer under vacuum atmosphere.

Another embodiment of the method for manufacturing a FED with an integrated triode structure, comprises: (a) forming, on a substrate, a cathode layer, a gate insulating layer, a gate electrode layer, an anode insulating layer and an aluminum layer, in order; (b) converting the aluminum layer to an alumina layer using anodic oxidation, until the alumina layer has sub-microholes in a regular arrangement pattern and a barrier layer remained at the lower part of the sub-microholes; (c) extending the depth of the sub-microholes in the alumina layer to the surface of the cathode layer; (c1) removing the alumina layer; (d) forming emitters in the sub-microholes, the emitters being adhered to the cathode layer; (e) forming a phosphor layer on the anode insulating layer; and (f) forming an anode layer on the phosphor layer under vacuum atmosphere.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

A field emission display (FED) with an integrated triode structure of the present invention comprises a substrate; a cathode layer positioned on the substrate; a gate insulating layer, which is positioned on the cathode layer and has a plurality of sub-microholes arranged in a regular pattern; a gate electrode layer, which is positioned on the gate insulating layer and has a plurality of sub-microholes arranged in the substantially same pattern as that of the sub-microholes in the gate insulating layer; an anode insulating layer, which is positioned on the gate electrode layer and has a plurality of sub-microholes arranged in the substantially same pattern as that of the sub-microholes in the gate insulating layer; emitters, which are positioned in wells defined by the sub-microholes in the gate insulating layer, the gate electrode layer and the anode insulating layer, and the emitters being adhered to the cathode layer; a phosphor layer positioned on the anode insulating layer; and an anode layer positioned on the phosphor layer.

The FED with an integrated triode structure may further comprise a resistive layer to be positioned between the cathode layer and the gate insulating layer. In this case, the emitters are adhered to the resistive layer.

Figure 1:
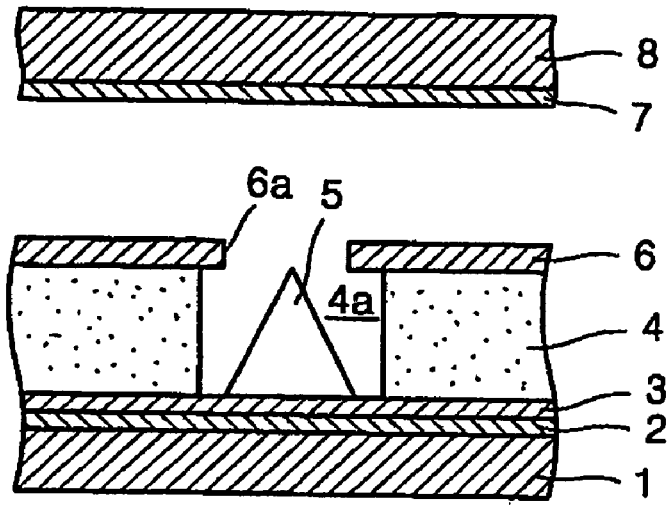
FIG. 1 shows an example of the structure of a conventional field emission display (FED)
Figure 2:
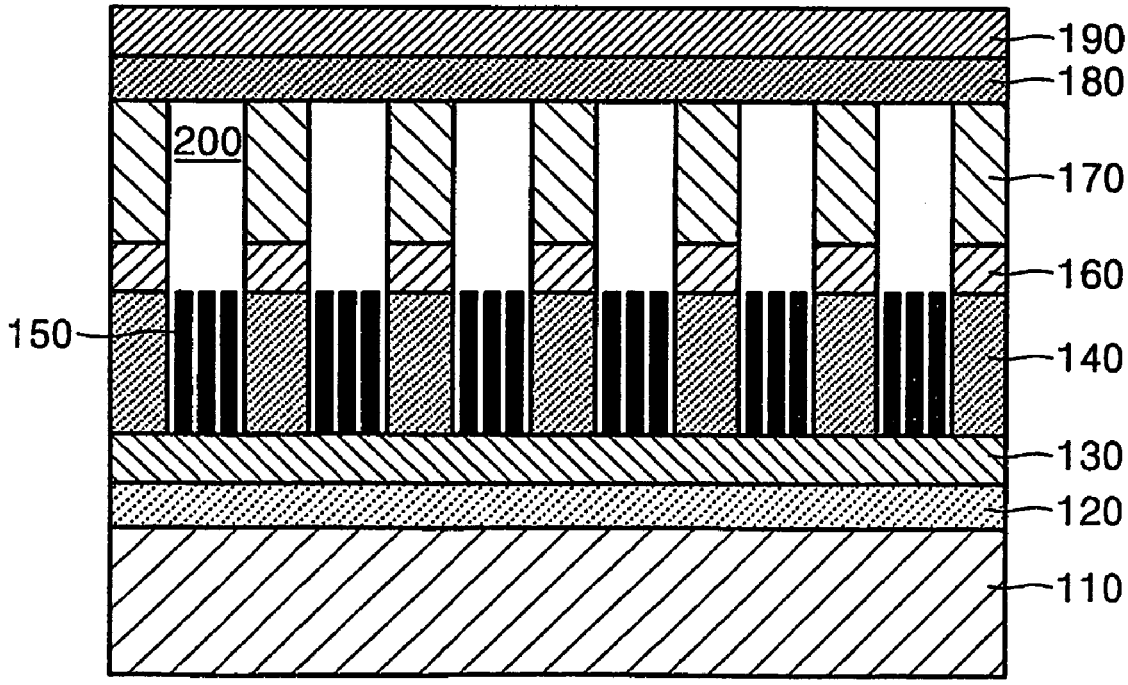
FIG. 2 shows a FED with an integrated triode structure according to an embodiment of the present invention.

FIG. 2 shows a schematic structure of a FED according to an embodiment of the present invention. Referring to FIG. 2, a cathode layer 120 is positioned on a substrate 110. A resistive layer 130 is positioned on the cathode layer 120. A gate insulating layer 140 is positioned on the resistive layer 130. A gate electrode layer 160 is positioned on the gate insulating layer 140. An anode insulating layer 170 is positioned on the gate electrode layer 160. A phosphor layer 180 is positioned on the anode insulating layer 170. An anode layer 190 is positioned on the phosphor layer 180.

The term, "integrated triode structure" as used herein refers to a distinctive structure of the present invention in which front and rear panels form a single body using the anode insulating layer 170 as an intermediate, in contrast to a conventional FED structure having a continued vacuum gap defined between front and rear panels by a spacer.

The cathode layer 120 and the gate electrode layer 160 may be patterned in a stripe form to realize matrix addressing. The cathode layer and the gate electrode layer may be arranged in such a way that stripes of both layers are orthogonal to each other. The anode layer 190 may be formed in a thin film covering a whole plane of the FED. In a case where the FED is used as a back light for a liquid crystal display (LCD), since there is no need to realize matrix addressing, the cathode layer 120 and the gate electrode layer 160 may be formed in a thin film covering a whole plane of the FED, not in a stripe form. The cathode layer 120, the resistive layer 130, and the gate electrode layer 160 may have various other types of circuit patterns.

In the gate insulating layer 140, the gate electrode layer 160, and the anode insulating layer 170, there are a plurality of through sub-microholes. Respective hole patterns of the gate insulating layer, the gate electrode layer, and the anode insulating layer are in substantially the same form. Therefore, the sub-microholes of the three layers form unitary channels that extend through the three layers. The respective sub-microholes in the gate insulating layer, the gate electrode layer, and the anode insulating layer may have the substantially same or different diameters. Wells 200 are defined by the sub-microholes of the three layers that form unitary channels.

The diameter of the wells 200 determines a distance between the tips of emitters 150 and the gate electrode layer. In this regard, the diameter of the wells 200 determines a desired value of an operation voltage applied to the gate electrode layer. That is, the diameter of the wells 200 can be determined depending on a desired value of an operation voltage applied to the gate electrode layer.

For example, the diameter of the wells may be several micrometers (μm) or less. The lower limit of the diameter of the wells may also be much smaller according to available minimal dimensions of the emitters 150. More preferably, the diameter of the wells is 1.0 μm or less, still more preferably, in the range of about 4 to 500 nm. Such small-diameter sized wells can significantly reduce an operation voltage applied to the gate electrode layer.

In order for such small-diameter sized wells to be uniformly formed over a large surface area, an etching process including anodic oxidation or a conventional photolithography can be used.

The emitters 150 are positioned in the respective wells 200 and adhered to the resistance layer 130. The height of the emitters 150 is adjusted such that the tips of the emitters 150 are as close as possible to the gate electrode layer 160. For example, the emitters 150 may be cone-shaped, microtips or carbon nanotubes. The resistive layer 130 serves to enhance uniformity of a current that flows in the emitters 150. The resistive layer 130 may be omitted. If the resistive layer is omitted, the emitters are adhered to the cathode layer.

The anode insulating layer 170 is an electrical insulator, and serves to maintain an appropriate distance between the emitters 150 and the anode layer 190 and as an intermediate for integrating front and rear panels. In addition, due to the anode insulating layer 170, the wells 200 forms respective separated discharge spaces. Therefore, electrons emitted from the emitters 150 hit only corresponding portions of the phosphor layer that are positioned directly above the wells 200.

In a conventional FED, rear and front panels maintain a gap therebetween by pillar-shaped spacers which are installed at several spots therebetween. Therefore, a continued vacuum gap is formed between rear and front panels. In this case, installing the spacers is troublesome. In addition, there arises a problem in that electrons emitted from an emitter may hit a phosphor in a neighboring pixel, not a phosphor in a corresponding pixel.

The anode insulating layer 170 used in the FED of the present invention solves these problems caused in a conventional FED.

With respect to an operation voltage of the anode, it is preferable to set the thickness of the anode insulating layer 170 to be as thin as possible. However, if the thickness of the anode insulating layer 170 is too thin, emission of electrons from the emitters 150 may also take place by an electric field from a voltage applied to the anode layer 190, in addition to by an electric field from a voltage applied to the gate electrode layer 160. If electrons are emitted from the emitters 150 by a voltage applied to the anode layer 190, wrong operation of the FED may occur. Therefore, it is preferable to set the thickness of the anode insulating layer 170 to as small as possible, taking into account the design values of a voltage applied to the anode layer 190 and a voltage applied to the gate electrode layer 160, and the diameter of the wells 200. For example, the thickness of the anode insulating layer 170 may be in the range of about 100 nm to 10 μm.

The phosphor layer 180 is positioned on the anode insulating layer 170. The phosphor layer 180 may comprise a monochromic phosphor or two or more types of phosphors. When the FED of the present invention is used as a color image display device, the phosphor layer 180 may comprise a red phosphor, a green phosphor, and a blue phosphor and these phosphors may be arranged in a regular pattern to form pixels. The phosphor layer 180 may further comprise a black matrix for identifying boundaries of pixels.

The anode layer 190, positioned on the phosphor layer 180, can cover the whole surface of the phosphor layer 180. Furthermore, the anode layer 190 serves as a sealing member so that each of the wells 200 can maintain a vacuum state. That is, the anode layer can hermetically seal discharge spaces defined by the wells. Preferably, the anode layer 190 is made of a transparent electrode material so that light emitted from the phosphor layer 180 is well transmitted.

The FED of the present invention may further comprise a front plate (not shown) to be positioned on the anode layer 190. The front plate serves to increase the sealing function of the anode layer 190 and prevent the anode layer 190 from being exposed outside.

According to an embodiment of the FED provided with the front plate, the anode layer 190 may be adhered to a surface of the front plate and the phosphor layer 180 may be adhered to the anode layer 190. In this case, the sealing function of the anode layer is not requisite. The anode layer may have various types of circuit patterns. When the front plate to which the phosphor layer and the anode layer are adhered are placed on the anode insulating layer 170, edges of the FED are hermetically sealed. At this time, the anode insulating layer 170 and the phosphor layer 180 are in contact with each other.

According to the present invention, there are no particular limitations on the materials, shapes, and dimensions of the substrate 110, the cathode layer 120, the resistive layer 130, the gate insulating layer 140, the gate electrode layer 160, the emitters 150, the anode insulating layer 170, the phosphor layer 180, the anode layer 190, and the front plate (not shown). Therefore, all the materials, shapes, and dimensions to be used in FEDs may be applied to the present invention.

In particular, suitable materials for the anode insulating layer 170 include, for example, $SiO_2$, SiCOH, and insulating metal oxides such as alumina.

The present invention also provides a method for manufacturing the above-described FED with an integrated triode structure.

An embodiment of the method, which produces a FED with the anode insulating layer formed of alumina, comprises (a) forming, on a substrate, a cathode layer, a gate insulating layer, a gate electrode layer, and an aluminum layer, in order; (b) converting the aluminum layer to an alumina layer using anodic oxidation, the alumina layer having sub-microholes in a regular arrangement pattern and a barrier layer remained at the lower part of the sub-microholes; (c) extending the depth of the sub-microholes in the alumina layer to the surface of the cathode layer; (d) forming emitters in the sub-microholes, the emitters being adhered to the cathode layer; (e) forming a phosphor layer on the alumina layer; and (f) forming an anode layer on the phosphor layer under vacuum atmosphere.

Step (a) may further comprise forming a resistive layer on the cathode layer. In this case, in step (c), the depth of the sub-microholes is extended to the surface of the resistive layer and, in step (d), the emitters are adhered to the resistive layer.

Hereinafter, an example of a method for manufacturing a FED with an integrated triode structure of the present invention will be described in detail with reference to FIGS. 3A to 3F.

Figure 3A:
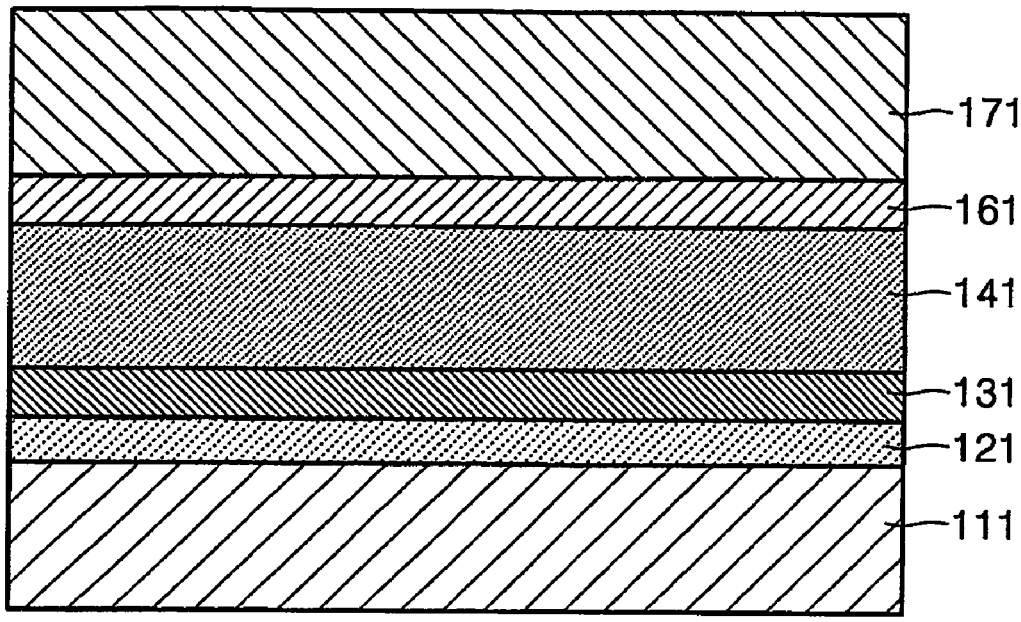
FIGS. 3A through 3F show subsequent processes for fabrication of a FED with an integrated triode structure according to an embodiment of the present invention.

First, referring to FIG. 3A, a material for a cathode layer 121 is applied on a substrate 111 using sputtering, vacuum evaporation, or plating, for example. For example, the substrate may be a nonconducting or semiconductive material. The nonconducting material is a glass or polymer material substrate, for example. The semiconductive material is a silicon wafer, for example. The material for the cathode layer 121 may be, for example, an electroconductive metal material, an electroconductive metal oxide material, an electroconductive metal nitride material, an electroconductive metal sulfide material, an electroconductive polymer material, alone or in combination. Examples of the electroconductive metal material include gold, tungsten, chromium, niobium, aluminum, titanium, and an alloy thereof. Examples of the electroconductive metal oxide material include $TiO_2$ and $Nb_2O_5$. The electroconductive metal nitride material is GaN, for example. Examples of the electroconductive metal sulfide material include ZnS and CdS. Examples of the electroconductive polymer material include polyimides and polyanilines.

On the cathode layer 121 thus formed, a resistive layer 131 is formed using low-pressure chemical vapor deposition or reactive sputtering, for example. The formation of the resistive layer may be omitted. The material for the resistive layer may be amorphous silicon doped with phosphorus (for example), alumina, or the like.

On the resistive layer 131 (on the cathode layer if the resistive layer is omitted) thus formed, a gate insulating layer 141 is formed using low-pressure chemical vapor deposition or reactive sputtering, for example. Suitable materials for the gate insulating layer include $SiO_2$, SiCOH, and insulating metal oxides such as alumina.

On the gate insulating layer 141 thus formed, a gate electrode layer 161 is formed using sputtering, vacuum evaporation, or plating, for example. The material for the gate electrode layer may be an electroconductive metal material, an electroconductive metal oxide material, an electroconductive metal nitride material, an electroconductive metal sulfide material, an electroconductive polymer material, alone or in combination. Examples of the electroconductive metal material include gold, tungsten, chromium, niobium, aluminum, titanium, and an alloy thereof. Examples of the electroconductive metal oxide material include $TiO_2$ and $Nb_2O_5$. The electroconductive metal nitride material may be GaN. Examples of the electroconductive metal sulfide material include ZnS and CdS. Examples of the electroconductive polymer material include polyimide and polyaniline.

On the gate electrode layer 161 thus formed, an aluminum layer 171 is formed using sputtering, vacuum evaporation, or plating, for example.

The aluminum layer 171 is converted to an alumina layer 171A using the following anodic oxidation. First, the aluminum layer is subjected to electrolytic polishing to eliminate the surface roughness of the aluminum layer. Then, the aluminum layer 171 is set to a positive electrode in an aqueous solution such as phosphoric acid, oxalic acid, sulfuric acid, sulfonic acid, and chromic acid. Then, when a direct current voltage of about 1 to 200 V is applied to the aluminum layer 171, the aluminum layer 171 is converted to the alumina layer 171A. The degree of conversion of the aluminum layer to the alumina layer is proportional to the time required for anodic oxidation. By way of an example, when anodic oxidation is carried out under the conditions including 15° C., 40 V, and 0.3 M aqueous solution of oxalic acid, the aluminum layer is converted to the alumina layer at a rate of about 1 μm thickness per 10 minutes.

Figure 3B:
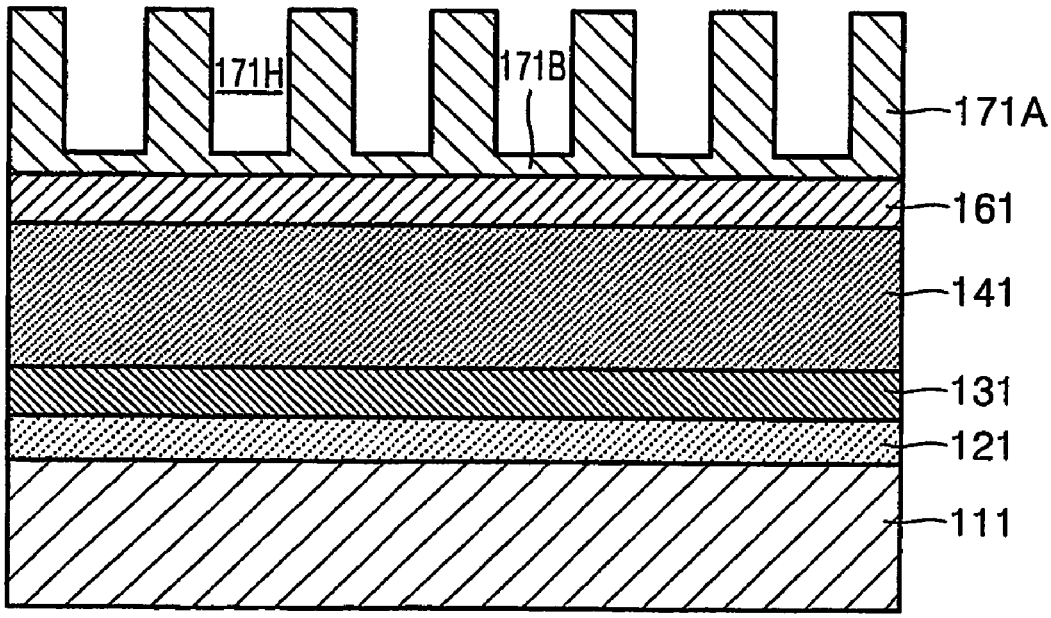

When application of a voltage is continued, a large number of sub-microholes 171H with a nanometer-sized diameter and a regular arrangement are formed in the alumina layer 171A, as shown in FIG. 3B. Then, a barrier layer 171B is remained at the lower part of the alumina layer 171A.

Figure 5A:
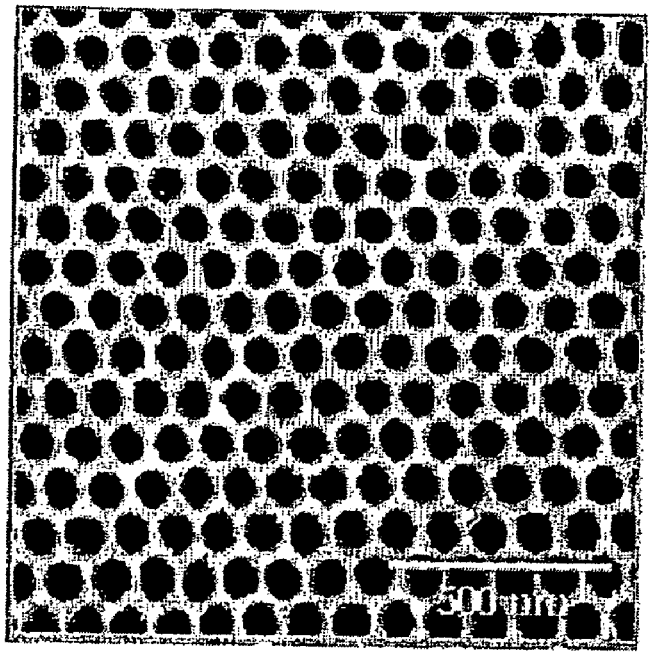
FIG. 5A is a photograph showing a well pattern of an alumina layer formed according to an embodiment of the present invention.
Figure 5B:
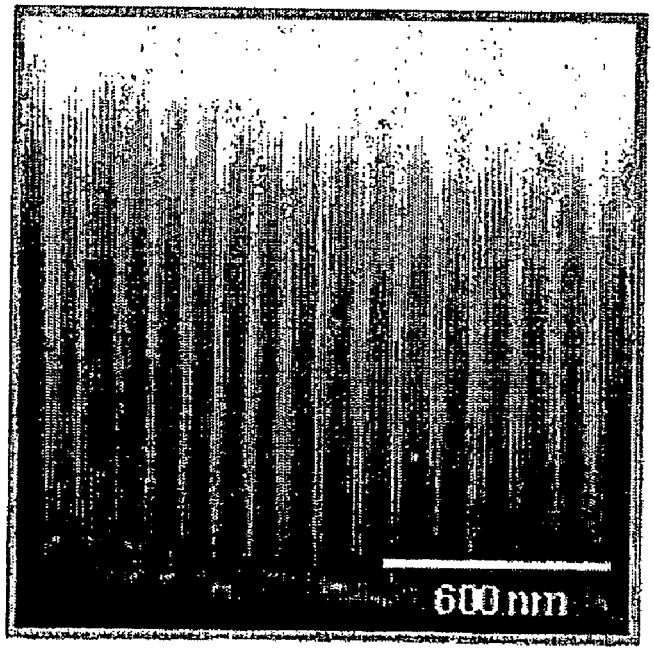
FIG. 5B is a photograph showing the longitudinal sections of wells formed according to an embodiment of the present invention.

The sub-microholes formed in the alumina layer using anodic oxidation may have a honeycomb pattern composed of an array of hexagonal cells (see FIGS. 5A and 5B). The diameter of the sub-microholes and the number of the sub-microholes per unit area can be adjusted by varying anodic oxidation conditions such as an applied voltage, a type, concentration, and temperature of an electrolyte. By way of an example, when anodic oxidation is carried out at an applied voltage of 25 V, a reaction temperature of 10° C., and 0.3 M aqueous solution of sulfuric acid, the diameter of the resultant sub-microholes is about 20 nm. When anodic oxidation is carried out at an applied voltage of 195 V, a reaction temperature of 0° C., and 0.3 M aqueous solution of phosphoric acid, the diameter of the resultant sub-microholes is about 100 nm. The number of the sub-microholes formed per unit area may be generally in the range of $10^8$ to $10^{11}$ per $cm^2$, but may vary depending on an applied voltage. The diameter of the sub-microholes available through anodic oxidation is typically in the range of about 4 to 500 nm. The diameter of the sub-microholes may also be adjusted by post-chemical treatment using phosphoric acid or sodium hydroxide, while the number of the sub-microholes per unit area can remain unchanged. By the post-chemical treatment, the diameter of the sub-microholes may be increased up to, for example, about 500 nm or more. The hole-to-hole distance and the thickness of the barrier layer are proportional to a voltage to be applied upon anodic oxidation. By way of an example, upon anodic oxidation under the conditions including 15° C. and 0.3 M aqueous solution of oxalic acid, when an applied voltage increases by 10 V, the hole-to-hole distance increases by about 27 nm. By using such anodic oxidation, the diameter of the sub-microholes formed in the alumina layer can be very easily adjusted to 1 μm or less.

When anodic oxidation is used, the formation of a photoresist layer for well patterning, involved in a conventional FED fabrication process, is omitted. Anodic oxidation allows easy formation of a finer well pattern with more enhanced resolution over a large area, when compared to conventional well patterning by a photoresist layer.

Figure 3C:
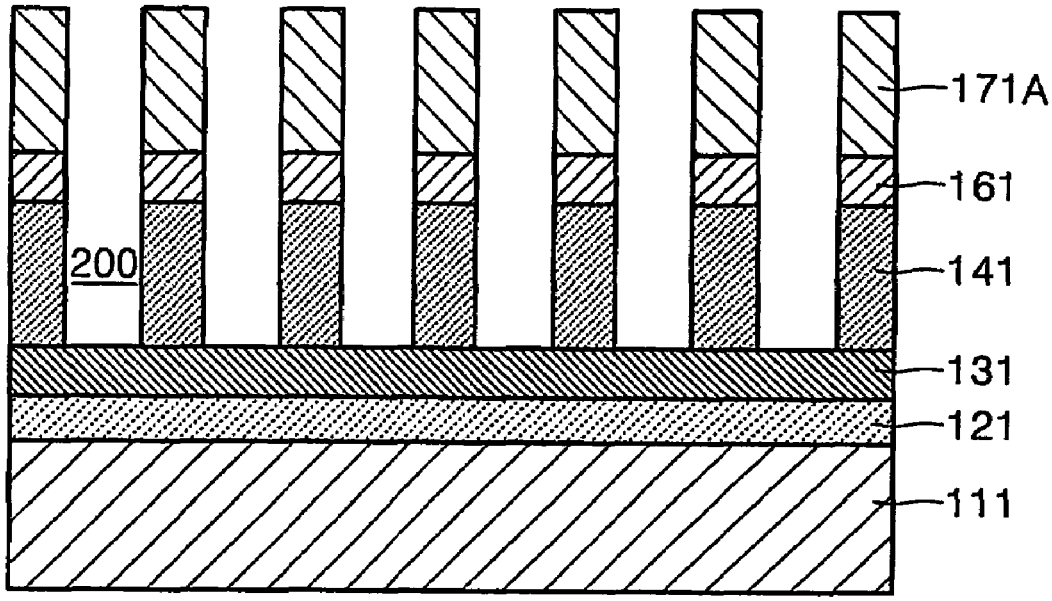

Next, an etching process is carried out to extend the depth of the sub-microholes 171H to the surface of the resistive layer 131. In an embodiment wherein the resistive layer is omitted, the depth of the sub-microholes 171H is extended to the surface of the cathode layer 121. The useful etching process to be used herein may be ion milling, dry etching, wet etching, or anodic oxidation. By way of a specific example, reactive ion etching using a mixed gas of $CF_4$ and $O_2$ can be used. When the barrier layer 171B, the gate electrode layer 161, and the gate insulating layer 141, all of which are positioned under the sub-microholes 171H, are etched using reactive ion etching, wells 200, inside of which the emitters are positioned, are formed, as shown in FIG. 3C. Consequently, the sub-microholes formed in the gate insulating layer, the gate electrode layer, and the alumina layer form unitary channels.

When the gate metal layers or the alumina layer are selectively etched using selective soluble chemicals, the diameter of the sub-microholes may vary from layer to layer.

In the case of using an etching process wherein the whole surface of the alumina layer may be etched, it is preferable to form the alumina layer to be thicker than a desired thickness.

Figure 3D:
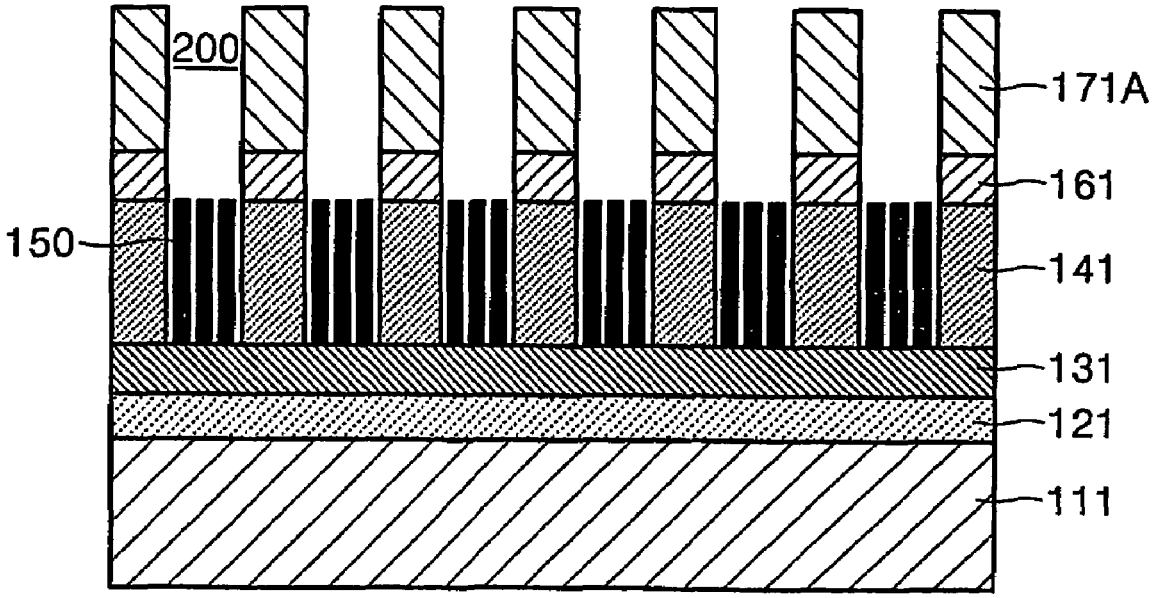

Next, the emitters 150 are formed in the respective wells 200 and being adhered to the surface of the resistance layer, as shown in FIG. 3D. The emitters can be formed from a metal material, a semiconductive material, or a carbon material, for example. Examples of the metal material include gold, platinum, nickel, molybdenum, tungsten, tantalum, chromium, titanium, cobalt, cesium, barium, hafnium, niobium, iron, rubidium, and an alloy thereof. Examples of the semiconductive material include gallium nitride (GaN), titanium oxide ($TiO_2$), and cadmium sulfide (CdS). Examples of the carbon material include carbon nanofiber, carbon nanotube, carbon nanoparticle, and amorphous carbon.

In an example of formation of the emitters made of a metal material, a direct current-, an alternating current-, or a pulse-voltage is applied to a solution of metal precursor such as metal sulfate, metal nitrate, and metal chloride to thereby grow metal particles in the wells. In this case, the height of growing metal emitters varies depending on the intensity and duration of current applied. Preferably, a metal to be used for formation of the emitters is selected from metals with good heat resistance, for example, such as tantalum, chromium, molybdenum, cobalt, nickel, titanium, and an alloy thereof.

In an example of formation of the emitters made of carbon nanotubes, first, a catalytic metal for growing carbon nanotubes is applied to the surface of the resistive layer in the wells. For this, the above-described method for formation of the emitters made of a metal material may be used. Then, carbon source for carbon nanotubes is supplied on the surface of the catalytic metal. By way of an example of a carbon supply method, pyrolysis of a mixed gas of hydrocarbon, carbon monooxide and hydrogen at a temperature in the range of about 200 to 1,000° C., or plasma degradation of the mixed gas can be used. A method of thiolizing pre-synthesized carbon nanotubes and then bonding the thiolized carbon nanotubes to silver (Ag) or gold (Au) may also be used. Pre-synthesized carbon nanotubes may also be applied to the surface of the cathode layer using electrophoresis.

When the resistive layer is omitted, the emitters are formed on the surface of the cathode layer and the above-described methods for formation of the emitters are applied, accordingly.

In each of the wells, only one emitter may be formed. Alternatively, one or more emitters may also be formed in each of the wells according to the diameter of the wells and the size of the emitters.

Figure 3E:
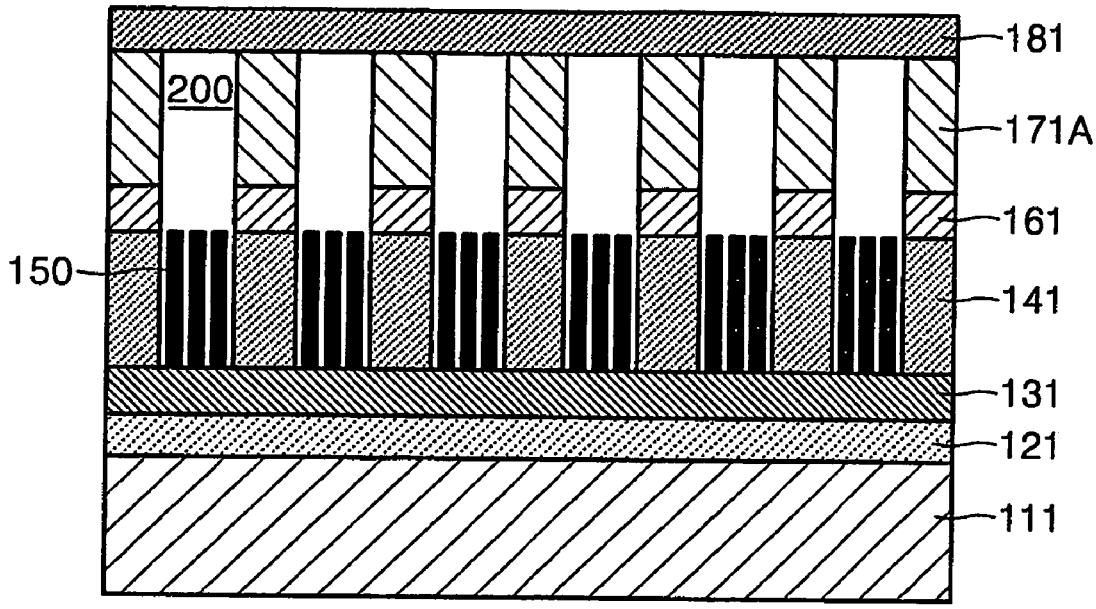

After the formation of the emitters, a phosphor layer 181 is formed on the alumina layer 171A, as shown in FIG. 3E. The phosphor layer may be formed using e-beam evaporation, thermal evaporation, sputtering, low-pressure chemical vapor deposition, sol-gel method, electroplating, or electroless plating. In the case of forming a patterned phosphor layer, printing may also be used. In printing, it is preferable to set the size of phosphor particles to be larger than the diameter of the wells. The phosphors may undergo sintering for completion of the phosphor layer. Metal-based phosphors may be angled-deposited using e-beam evaporation and ceramic-based phosphors may be formed using sputtering. In addition, a method of vacuum packaging a front panel provided with the phosphor layer may also be used.

The phosphors to be used in the phosphor layer can be selected from high-voltage phosphors and low-voltage phosphors, taking into account a drive voltage to be applied, intensity of a current, and luminous efficiency.

Figure 3F:
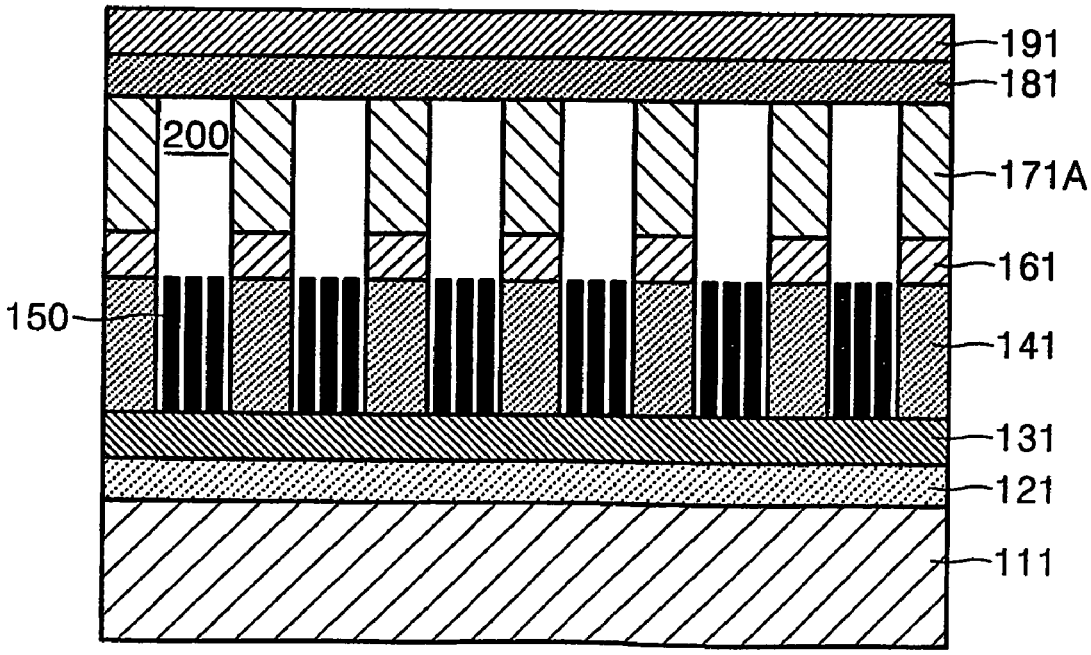

An anode layer 191 is formed on the phosphor layer 181, as shown in FIG. 3F. The anode layer can also serve to hermetically seal discharge spaces defined by the wells so that the discharge spaces are maintained in vacuum states appropriate to electron emission. In order to hermetically seal the discharge spaces in vacuum states, the anode layer is formed under vacuum atmosphere. The anode layer may be formed using e-beam evaporation or thermal evaporation, for example. The anode layer may be made of a transparent electrode material such as indium tin oxide (ITO).

Another embodiment of the method, which produces a FED with the anode insulating layer formed of other materials or alumina, comprises (a) forming, on a substrate, a cathode layer, a gate insulating layer, a gate electrode layer, an anode insulating layer and an aluminum layer, in order; (b) converting the aluminum layer to an alumina layer using anodic oxidation, the alumina layer having sub-microholes in a regular arrangement pattern and a barrier layer remained at the lower part of the sub-microholes; (c) extending the depth of the sub-microholes in the alumina layer to the surface of the cathode layer; (c1) removing the alumina layer; (d) forming emitters in the sub-microholes, the emitters being adhered to the cathode layer; (e) forming a phosphor layer on the anode insulating layer; and (f) forming an anode layer on the phosphor layer under vacuum atmosphere.

Step (a) may further comprise forming a resistive layer on the cathode layer. In this case, in step (c), the depth of the sub-microholes is extended to the surface of the resistive layer and, in step (d), the emitters are adhered to the resistive layer.

Hereinafter, an example of a method for manufacturing a FED with an integrated triode structure of the present invention will be described in detail with reference to FIGS. 4A to 4F.

Figure 4A:
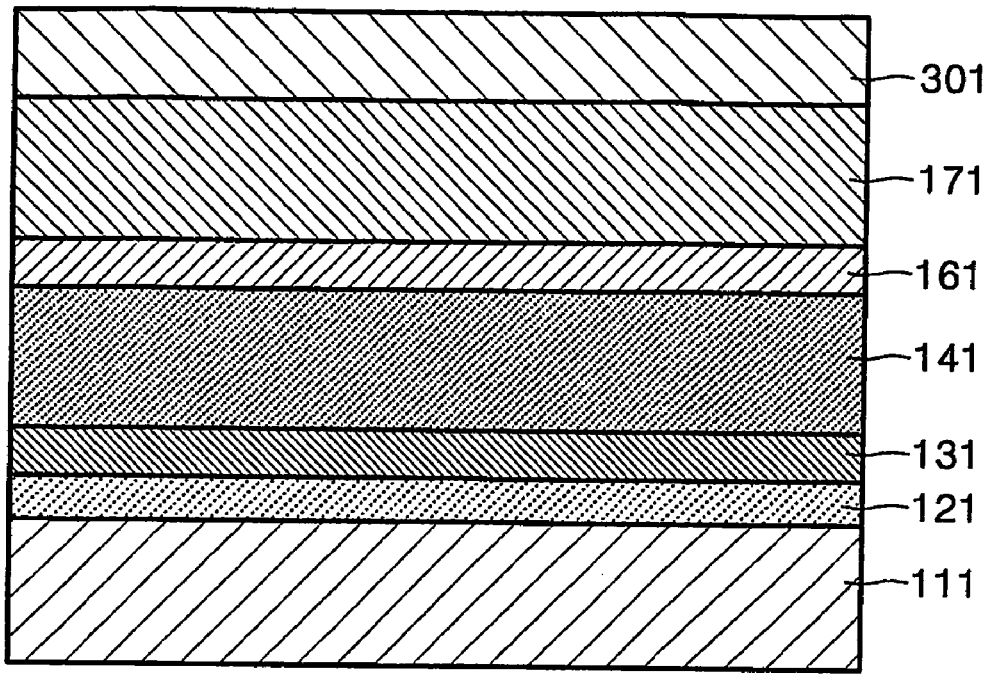
FIGS. 4A through 4F show subsequent processes for fabrication of a FED with an integrated triode structure according to another embodiment of the present invention.

First, referring to FIG. 4A, a material for a cathode layer 121 is applied on a substrate 111 using sputtering, vacuum evaporation, or plating, for example. For example, the substrate may be a nonconducting or semiconductive material. The nonconducting material is a glass or polymer material substrate, for example. The semiconductive material is a silicon wafer, for example. The material for the cathode layer 121 may be, for example, an electroconductive metal material, an electroconductive metal oxide material, an electroconductive metal nitride material, an electroconductive metal sulfide material, an electroconductive polymer material, alone or in combination. Examples of the electroconductive metal material include gold, tungsten, chromium, niobium, aluminum, titanium, and an alloy thereof. Examples of the electroconductive metal oxide material include $TiO_2$ and $Nb_2O_5$. The electroconductive metal nitride material is GaN, for example. Examples of the electroconductive metal sulfide material include ZnS and CdS. Examples of the electroconductive polymer material include polyimides and polyanilines.

On the cathode layer 121 thus formed, a resistive layer 131 is formed using low-pressure chemical vapor deposition or reactive sputtering, for example. The formation of the resistive layer may be omitted. The material for the resistive layer may be amorphous silicon doped with phosphorus (for example), alumina, or the like.

On the resistive layer 131 (on the cathode layer if the resistive layer is omitted) thus formed, a gate insulating layer 141 is formed using low-pressure chemical vapor deposition or reactive sputtering, for example. The suitable materials for the gate insulating layer include, for example, silicon oxide ($SiO_2$), SiCOH, and insulating metal oxides such as alumina.

On the gate insulating layer 141 thus formed, a gate electrode layer 161 is formed using sputtering, vacuum evaporation, or plating, for example. The material for the gate electrode layer may be an electroconductive metal material, an electroconductive metal oxide material, an electroconductive metal nitride material, an electroconductive metal sulfide material, an electroconductive polymer material, alone or in combination. Examples of the electroconductive metal material include gold, tungsten, chromium, niobium, aluminum, titanium, and an alloy thereof. Examples of the electroconductive metal oxide material include $TiO_2$ and $Nb_2O_5$. The electroconductive metal nitride material may be GaN. Examples of the electroconductive metal sulfide material include ZnS and CdS. Examples of the electroconductive polymer material include polyimide and polyaniline.

On the gate electrode layer 161 thus formed, an anode insulating layer 171 is formed using low-pressure chemical vapor deposition or reactive sputtering, for example. The suitable materials for the anode insulating layer include, for example, silicon oxide ($SiO_2$), SiCOH, and insulating metal oxides such as alumina.

On the anode insulating layer 171 thus formed, an aluminum layer 301 is formed using sputtering, vacuum evaporation, or plating, for example.

The aluminum layer 301 is converted to an alumina layer 301A using the following anodic oxidation. First, the aluminum layer is subjected to electrolytic polishing to eliminate the surface roughness of the aluminum layer. Then, the aluminum layer 301 is set to a positive electrode in an aqueous solution such as phosphoric acid, oxalic acid, sulfuric acid, sulfonic acid, and chromic acid. Then, when a direct current voltage of about 1 to 200 V is applied to the aluminum layer 301, the aluminum layer 301 is converted to the alumina layer 301A. The degree of conversion of the aluminum layer to the alumina layer is proportional to the time required for anodic oxidation. By way of an example, when anodic oxidation is carried out under the conditions including 15° C., 40 V, and 0.3 M aqueous solution of oxalic acid, the aluminum layer is converted to the alumina layer at a rate of about 1 μm thickness per 10 minutes.

Figure 4B:
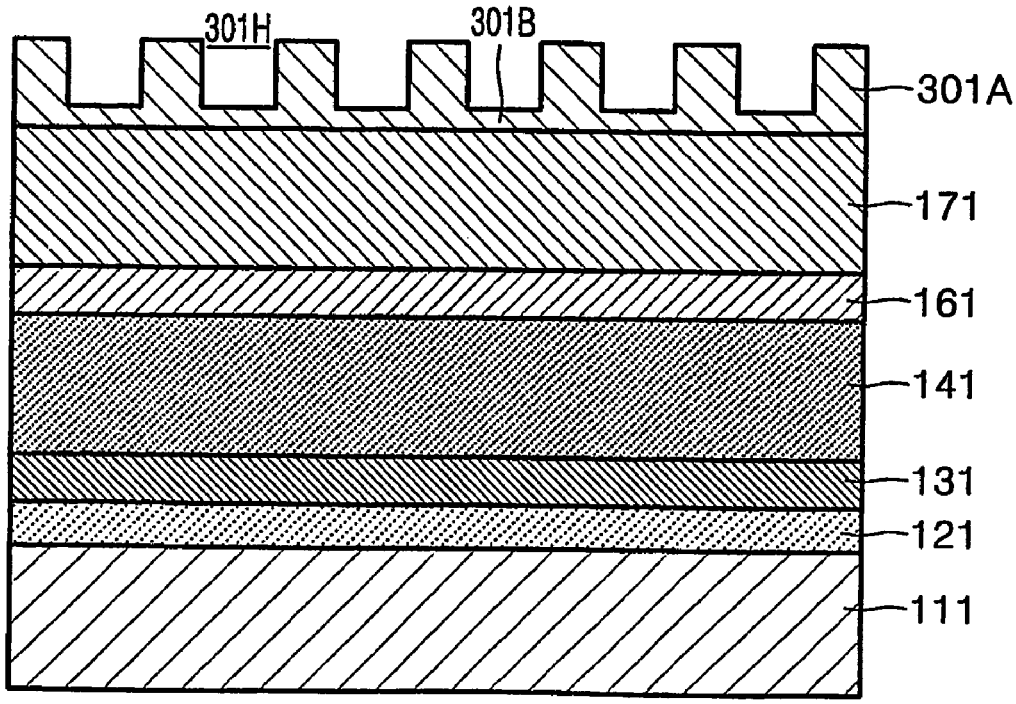

When application of a voltage is continued, a large number of sub-microholes 301H with a nanometer-sized diameter and a regular arrangement are formed in the alumina layer 301A, as shown in FIG. 4B. Then, a barrier layer 301B is remained at the lower part of the alumina layer 301A.

The sub-microholes formed in the alumina layer using anodic oxidation may have a honeycomb pattern composed of an array of hexagonal cells. The diameter of the sub-microholes and the number of the sub-microholes per unit area can be adjusted by varying anodic oxidation conditions such as an applied voltage, a type, concentration, and temperature of an electrolyte. By way of an example, when anodic oxidation is carried out at an applied voltage of 25 V, a reaction temperature of 10° C., and 0.3 M aqueous solution of sulfuric acid, the diameter of the resultant sub-microholes is about 20 nm. When anodic oxidation is carried out at an applied voltage of 195 V, a reaction temperature of 0° C., and 0.3 M aqueous solution of phosphoric acid, the diameter of the resultant sub-microholes is about 100 nm. The number of the sub-microholes formed per unit area may be generally in the range of $10^8$ to $10^{11}$ per $cm^2$, but may vary depending on an applied voltage. The diameter of the sub-microholes available through anodic oxidation is typically in the range of about 4 to 500 nm. The diameter of the sub-microholes may also be adjusted by post-chemical treatment using phosphoric acid or sodium hydroxide, while the number of the sub-microholes per unit area can remain unchanged. By the post-chemical treatment, the diameter of the sub-microholes may be increased up to, for example, about 500 nm or more. The hole-to-hole distance and the thickness of the barrier layer are proportional to a voltage to be applied upon anodic oxidation. By way of an example, upon anodic oxidation under the conditions including 15° C. and 0.3 M aqueous solution of oxalic acid, when an applied voltage increases by 10 V, the hole-to-hole distance increases by about 27 nm. By using such anodic oxidation, the diameter of the sub-microholes formed in the alumina layer can be very easily adjusted to 1 μm or less.

When anodic oxidation is used, the formation of a photoresist layer for well patterning, involved in a conventional FED fabrication process, is omitted. Anodic oxidation allows easy formation of a finer well pattern with more enhanced resolution over a large area, when compared to conventional well patterning by a photoresist layer.

Figure 4C:
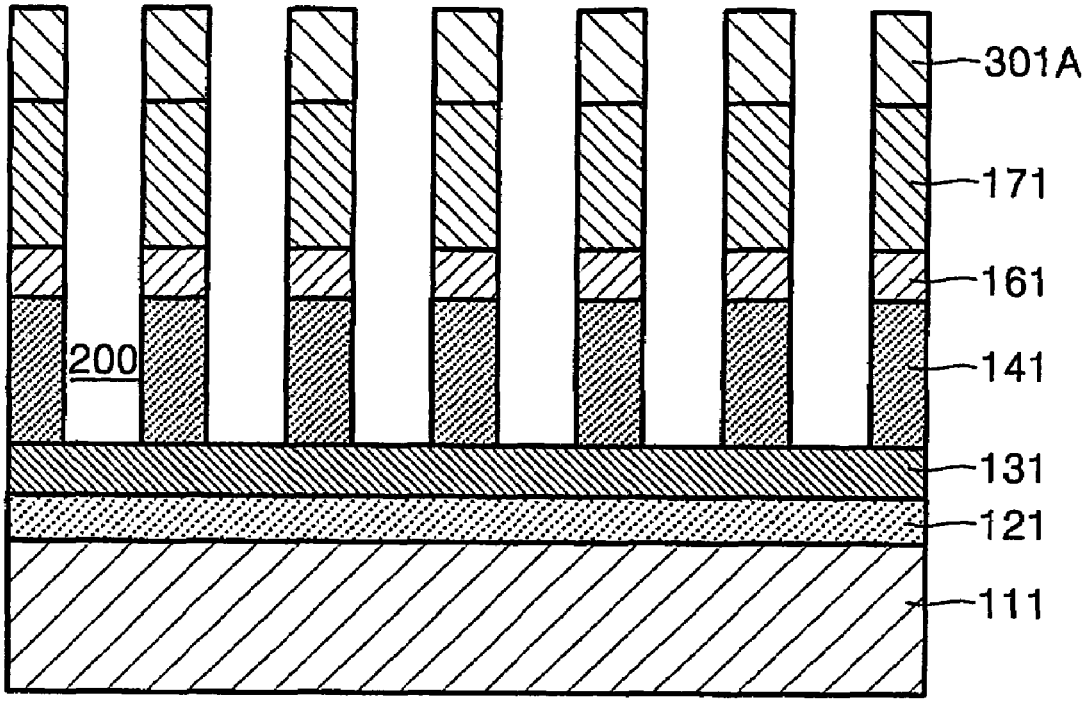

Next, an etching process is carried out to extend the depth of the sub-microholes 301H to the surface of the resistive layer 131. In an embodiment wherein the resistive layer is omitted, the depth of the sub-microholes 301H is extended to the surface of the cathode layer 121. The useful etching process to be used herein may be ion milling, dry etching, wet etching, or anodic oxidation. By way of a specific example, reactive ion etching using a mixed gas of $CF_4$ and $O_2$ can be used. When the barrier layer 301B, the anode insulating layer 171, the gate electrode layer 161, and the gate insulating layer 141, all of which are positioned under the sub-microholes 301H, are etched using reactive ion etching, wells 200, inside of which the emitters are positioned, are formed, as shown in FIG. 4C. Consequently, the sub-microholes formed in the gate insulating layer, the gate electrode layer, the anode insulating layer and the alumina layer form unitary channels.

When the gate metal layers or the alumina layer are selectively etched using selective soluble chemicals, the diameter of the sub-microholes may vary from layer to layer.

When the formation of the wells 200 is finished, the remaining alumina layer 301A is removed by, for example, dipping it in a solution of phosphoric acid or a mixed solution of phosphoric acid and chromic acid.

Figure 4D:
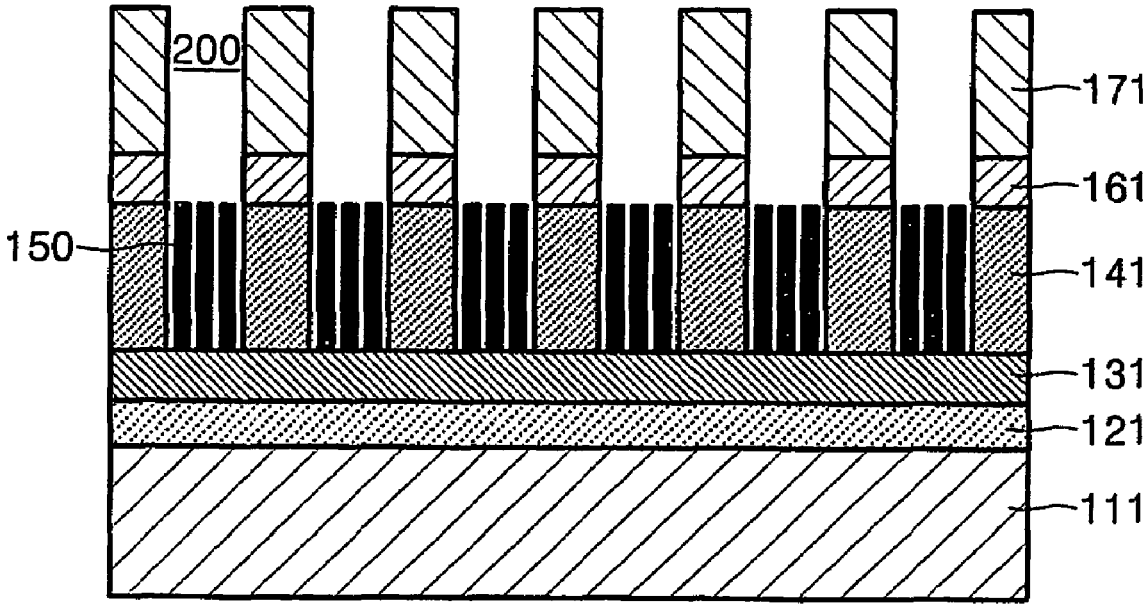

Next, the emitters 150 are formed in the respective wells 200 and being adhered to the surface of the resistance layer, as shown in FIG. 4D. The emitters can be formed from a metal material, a semiconductive material, or a carbon material, for example. Examples of the metal material include gold, platinum, nickel, molybdenum, tungsten, tantalum, chromium, titanium, cobalt, cesium, barium, hafnium, niobium, iron, rubidium, and an alloy thereof. Examples of the semiconductive material include gallium nitride (GaN), titanium oxide ($TiO_2$), and cadmium sulfide (CdS). Examples of the carbon material include carbon nanofiber, carbon nanotube, carbon nanoparticle, and amorphous carbon.

In an example of formation of the emitters made of a metal material, a direct current-, an alternating current-, or a pulse-voltage is applied to a solution of metal precursor such as metal sulfate, metal nitrate, and metal chloride to thereby grow metal particles in the wells. In this case, the height of growing metal emitters varies depending on the intensity and duration of current applied. Preferably, a metal to be used for formation of the emitters is selected from metals with good heat resistance, for example, such as tantalum, chromium, molybdenum, cobalt, nickel, titanium, and an alloy thereof.

In an example of formation of the emitters made of carbon nanotubes, first, a catalytic metal for growing carbon nanotubes is applied to the surface of the resistive layer in the wells. For this, the above-described method for formation of the emitters made of a metal material may be used. Then, carbon source for carbon nanotubes is supplied on the surface of the catalytic metal. By way of an example of a carbon supply method, pyrolysis of a mixed gas of hydrocarbon, carbon monooxide and hydrogen at a temperature in the range of about 200 to 1,000° C., or plasma degradation of the mixed gas can be used. A method of thiolizing pre-synthesized carbon nanotubes and then bonding the thiolized carbon nanotubes to silver (Ag) or gold (Au) may also be used. Pre-synthesized carbon nanotubes may also be applied to the surface of the cathode layer using electrophoresis.

When the resistive layer is omitted, the emitters are formed on the surface of the cathode layer and the above-described methods for formation of the emitters are applied, accordingly.

In each of the wells, only one emitter may be formed. Alternatively, one or more emitters may also be formed in each of the wells according to the diameter of the wells and the size of the emitters.

Figure 4E:
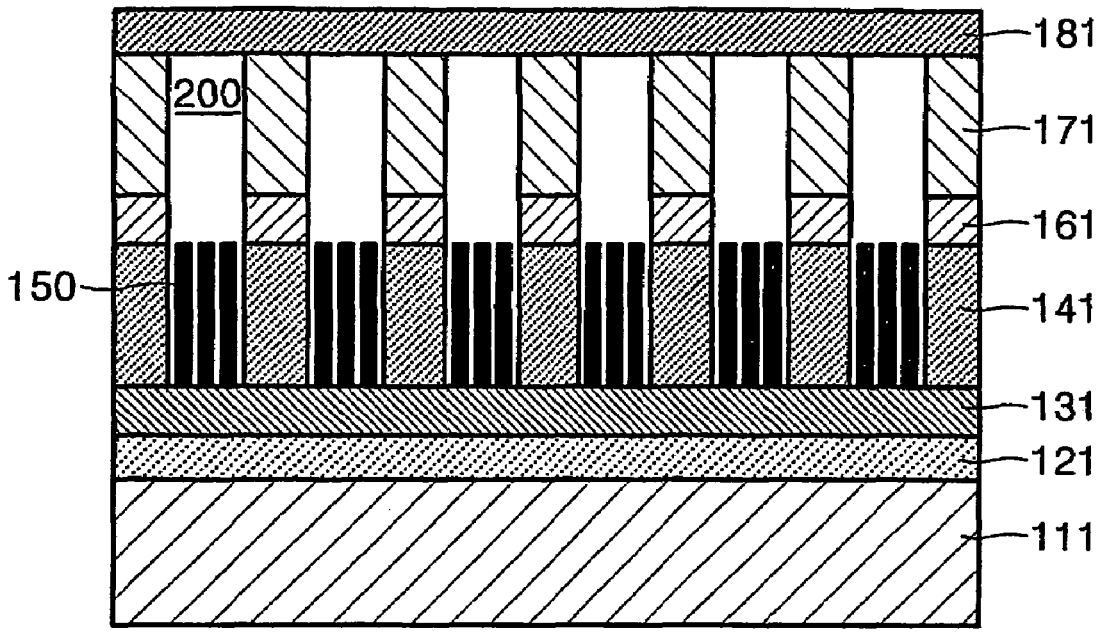

After the formation of the emitters, a phosphor layer 181 is formed on the anode insulating layer 171, as shown in FIG. 4E. The phosphor layer may be formed using e-beam evaporation, thermal evaporation, sputtering, low-pressure chemical vapor deposition, sol-gel method, electroplating, or electroless plating. In the case of forming a patterned phosphor layer, printing may also be used. In printing, it is preferable to set the size of phosphor particles to be larger than the diameter of the wells. The phosphors may undergo sintering for completion of the phosphor layer. Metal-based phosphors may be angled-deposited using e-beam evaporation and ceramic-based phosphors may be formed using sputtering. In addition, a method of vacuum packaging a front panel provided with the phosphor layer may also be used.

The phosphors to be used in the phosphor layer can be selected from high-voltage phosphors and low-voltage phosphors, taking into account a drive voltage to be applied, intensity of a current, and luminous efficiency.

Figure 4F:
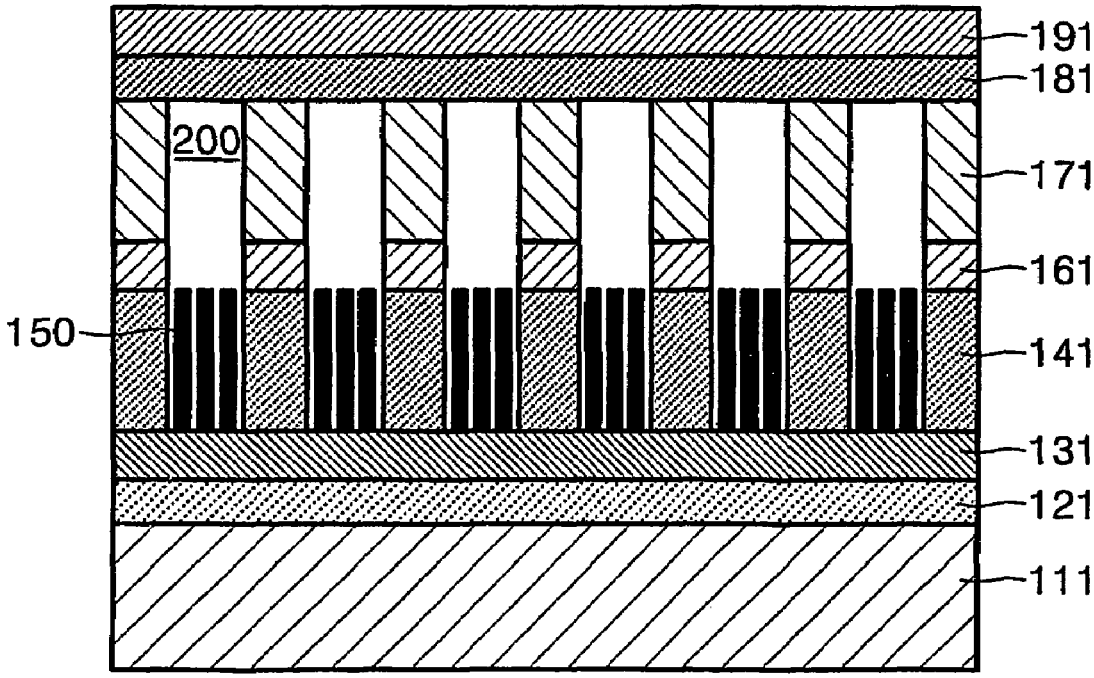

An anode layer 191 is formed on the phosphor layer 181, as shown in FIG. 4F. The anode layer can also serve to hermetically seal discharge spaces defined by the wells so that the discharge spaces are maintained in vacuum states appropriate to electron emission. In order to hermetically seal the discharge spaces in vacuum states, the anode layer is formed under vacuum atmosphere. The anode layer may be formed using e-beam evaporation or thermal evaporation, for example. The anode layer may be made of a transparent electrode material such as indium tin oxide (ITO).

A field emission display (FED) of the present invention has an integrated triode structure, in which rear and front panels are supported by an anode insulating layer. Therefore, there is no need to have a separate separator and a complex packaging process can be omitted.

In a fabrication method for the FED using anodic oxidation, a well with a submicron-sized diameter can be easily formed throughout a large area. Therefore, a distance between the tip of an emitter and a gate electrode layer and a distance between the tip of the emitter and an anode can be significantly reduced. Consequently, by using the FED fabrication method of the present invention, FEDs with a large area and a significantly reduced operation voltage can be more easily produced.

What is claimed is:

1. A method for manufacturing a FED with an integrated triode structure, the method comprising:

(a) forming, on a substrate, a cathode layer, a gate insulating layer, a gate electrode layer, and an aluminum layer, in order;

(b) converting the aluminum layer to an alumina layer using anodic oxidation, until the alumina layer has sub-microholes in a regular arrangement pattern and a barrier layer remained at the lower part of the sub-microholes;

(c) extending the depth of the sub-microholes in the alumina layer to the surface of the cathode layer;

(d) forming emitters in the sub-microholes, the emitters being adhered to the cathode layer;

(e) forming a phosphor layer on the alumina layer; and (f) forming an anode layer on the phosphor layer under vacuum atmosphere.

2. The method according to claim 1, wherein step (a) further comprises forming a resistive layer on the cathode layer, in step (c), the depth of the sub-microholes is extended to the surface of the resistive layer and, and in step (d), the emitters are adhered to the resistive layer.

3. The method according to claim 1, wherein in step (b), the anodic oxidation comprises applying a positive voltage to the aluminum layer in aqueous solution of acidic electrolyte.

4. The method according to claim 3, wherein the acidic electrolyte is selected from the group consisting of oxalic acid, sulfuric acid, sulfonic acid, phosphoric acid, and chromic acid.

5. The method according to claim 1, wherein in step (b), the diameter of the sub-microholes is in the range of 4 to 500 nm.

6. The method according to claim 1, wherein step (c) is carried out using ion milling, dry etching, wet etching, or anodic oxidation.

7. The method according to claim 1, wherein in step (e), a phosphor is applied to the alumina layer using e-beam evaporation, thermal evaporation, sputtering, low-pressure chemical vapor deposition, sol-gel method, electroplating, or electroless plating.

8. The method according to claim 1, wherein the method further comprises increasing the diameter of the sub-microholes in the alumina layer by post-chemical treatment after step (b).

9. A method for manufacturing a FED with an integrated triode structure, the method comprising:

(a) forming, on a substrate, a cathode layer, a gate insulating layer, a gate electrode layer, an anode insulating layer and an aluminum layer, in order;

(b) converting the aluminum layer to an alumina layer using anodic oxidation, until the alumina layer has sub-microholes in a regular arrangement pattern and a barrier layer remains at the lower part of the sub-microholes;

(c) extending the depth of the sub-microholes in the alumina layer to the surface of the cathode layer;

(c1) removing the alumina layer;

(d) forming emitters in the sub-microholes, the emitters being adhered to the cathode layer;

(e) forming a phosphor layer on the anode insulating layer; and (f) forming an anode layer on the phosphor layer under vacuum atmosphere.

* * * * *